US007926907B2

(12) United States Patent
Kondo

(10) Patent No.: US 7,926,907 B2
(45) Date of Patent: Apr. 19, 2011

(54) IMAGE RECORDING APPARATUS

(75) Inventor: Etsuyasu Kondo, Tokyo (JP)

(73) Assignee: Olympus Corporation, Tokyo (JP)

( * ) Notice: Subject to any disclaimer, the term of this patent is extended or adjusted under 35 U.S.C. 154(b) by 931 days.

(21) Appl. No.: 11/888,085

(22) Filed: Jul. 31, 2007

(65) Prior Publication Data

US 2008/0031655 A1 Feb. 7, 2008

(30) Foreign Application Priority Data

Aug. 4, 2006 (JP) ..... 2006-213487

(51) Int. Cl.
*B41J 23/00* (2006.01)
*B41J 25/308* (2006.01)

(52) U.S. Cl. ..... 347/37; 347/8; 347/38

(58) Field of Classification Search ..... 347/38
See application file for complete search history.

(56) References Cited

U.S. PATENT DOCUMENTS 6,426,764 B2 * 7/2002 Shiida et al. ..... 347/8
7,204,571 B2 * 4/2007 Platt et al. ..... 347/8

FOREIGN PATENT DOCUMENTS

JP 11-277764 A 10/1999

* cited by examiner

*Primary Examiner* — Omar Rojas
(74) *Attorney, Agent, or Firm* — Holtz, Holtz, Goodman & Chick, PC

(57) ABSTRACT

An image recording apparatus includes a rotational drum for retaining a recording medium on an outer circumference of the drum; a head retention member placed opposite to the outer circumference of the drum, for retaining a print head printing on the recording medium by jetting ink from a plurality of nozzles; and a support member for supporting the head retention member at a prescribed position in relation to the drum, the support member being engaged with the rotation shaft of the drum.

12 Claims, 13 Drawing Sheets

IMAGE RECORDING APPARATUS

CROSS REFERENCE TO RELATED APPLICATIONS

This application is based on and claims the benefit of priority from the prior Japanese Patent Application No. 2006-213487 filed on Aug. 4, 2006, the entire contents of which are incorporated herein by reference.

BACKGROUND OF THE INVENTION

1. Field of the Invention

The present invention relates to an image recording apparatus for recording an image on a sheet by jetting an ink from a plurality of nozzles.

2. Description of the Related Art

As an example of an image recording apparatus, an inkjet printer is for recording an image on a recording medium retained and conveyed by a conveyance mechanism in a high speed and high image quality by jetting an ink droplet from a plurality of nozzles of a print head. The inkjet printer is widely used for an office use for recording an image on a recording medium (i.e. a sheet) of a cut sheet form for instance. In recent years, the inkjet printer is also used for an industry use for recording images on a recording medium (i.e., a continuous sheet) such as a roll sheet as a result of a successful improvement of a throughput by constituting a line head arraying a number of print heads in a direction perpendicular to the conveyance direction of the recording medium.

In such an image recording apparatus, one of effective means for conveying a sheet in a cut form and a continuous sheet such as a roll sheet is conveyance means using a drum. In the case of using a drum for a conveyance mechanism, the print head is retained by maintaining a prescribed gap in relation to the drum for recording an image on the recording medium. In order to maintain a print quality, the print head requires maintenance for each prescribed time period. For this, the print head is retracted from the drum for forming a space between the print head and drum by an elevation mechanism when carrying out the maintenance of the print head. The maintenance of the print head is carried out by inserting a maintenance unit into the space. Upon finishing the maintenance of the print head, it is returned to the image recording position for recording an image by the elevation mechanism. In this event, the gap between the print head and drum always needs to be identical before and after the maintenance. That is, unless the print head is retained by keeping a prescribed gap in relation to the drum, an occurrence of a color shift, or such, is caused. As an example, a Laid-Open Japanese Patent Application Publication No. H11-277764 has disclosed an invention for making it possible to maintain the gap between a print head and a drum securely at a prescribed value before and after maintenance by three points holding mechanism.

SUMMARY OF THE INVENTION

An image recording apparatus according to the primary aspect of the present invention is one which comprises a rotational drum for retaining a recording medium on the outer circumference of the drum; a head retention member, being placed opposite to the outer circumference of the drum, for retaining a print head printing on the recording medium by jetting ink from a plurality of nozzles; and a support member for supporting the head retention member at a prescribed position in relation to the drum, wherein the support member is engaged with the rotation shaft of the drum.

An image recording apparatus according to another of the primary aspect of the present invention is one which comprises a rotational drum for retaining a recording medium on the outer circumference of the drum; a head retention member, being placed opposite to the outer circumference of the drum, for retaining a print head printing on the recording medium by jetting ink from a plurality of nozzles; and a support member for supporting the head retention member at a prescribed position in relation to the drum, wherein the support member retains the head retention member on the outer circumference surface of the drum.

DESCRIPTION OF THE PREFERRED EMBODIMENTS

Figure 1:
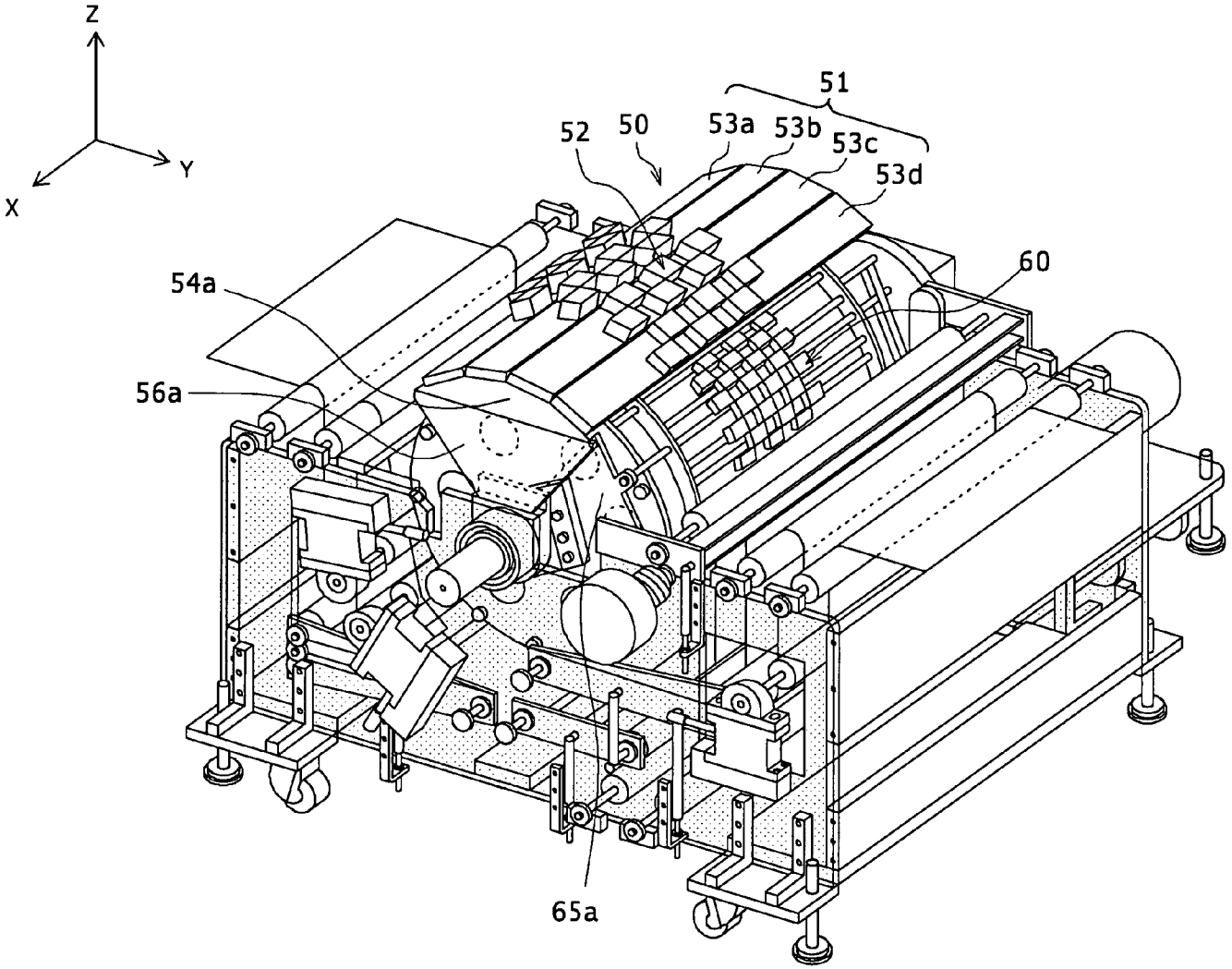
FIG. 1 is a diagonal view diagram of a printer unit.
Figure 2:
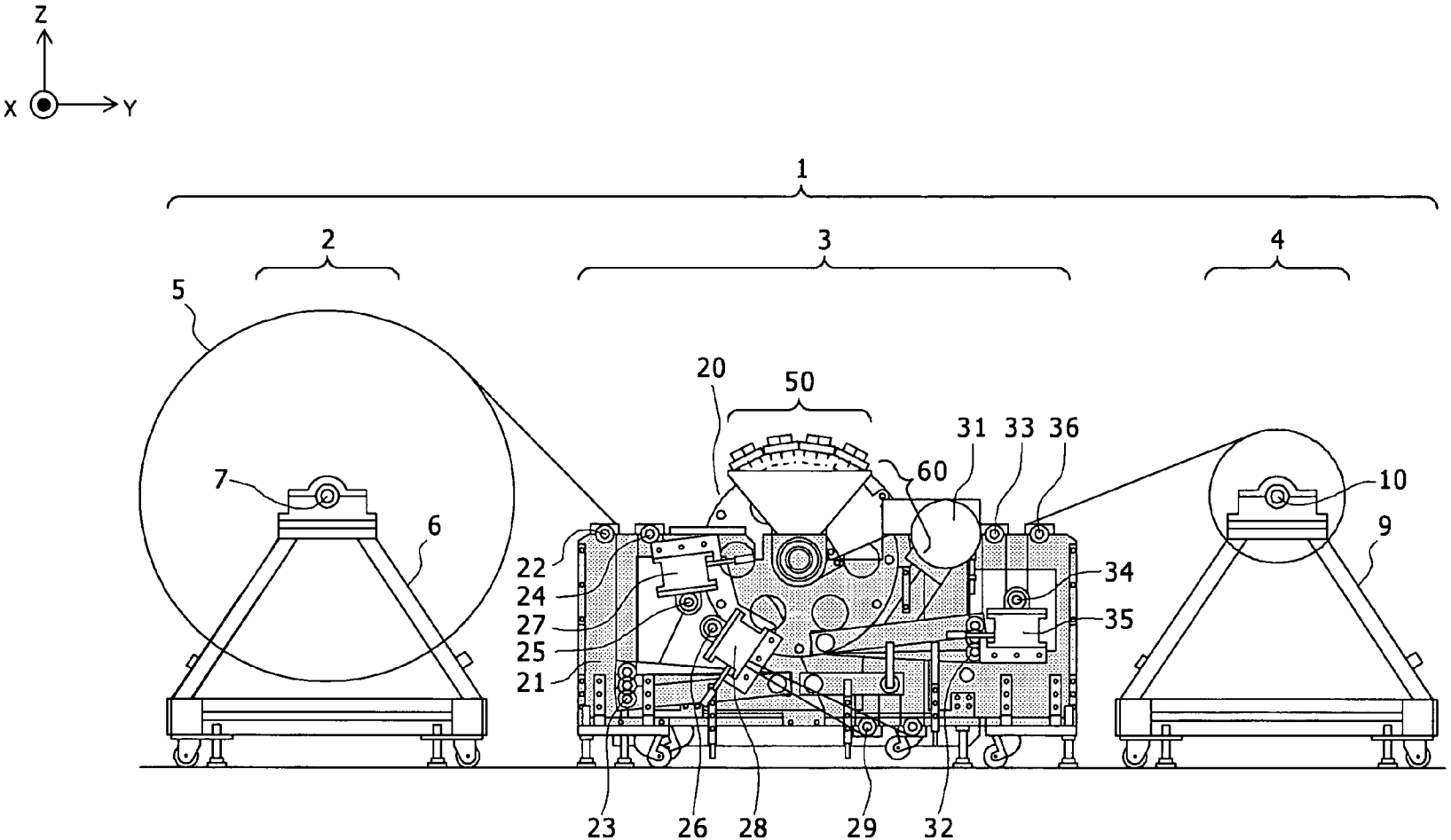
FIG. 2 is an outlined front view diagram showing an image recording apparatus of a first preferred embodiment.
Figure 3:
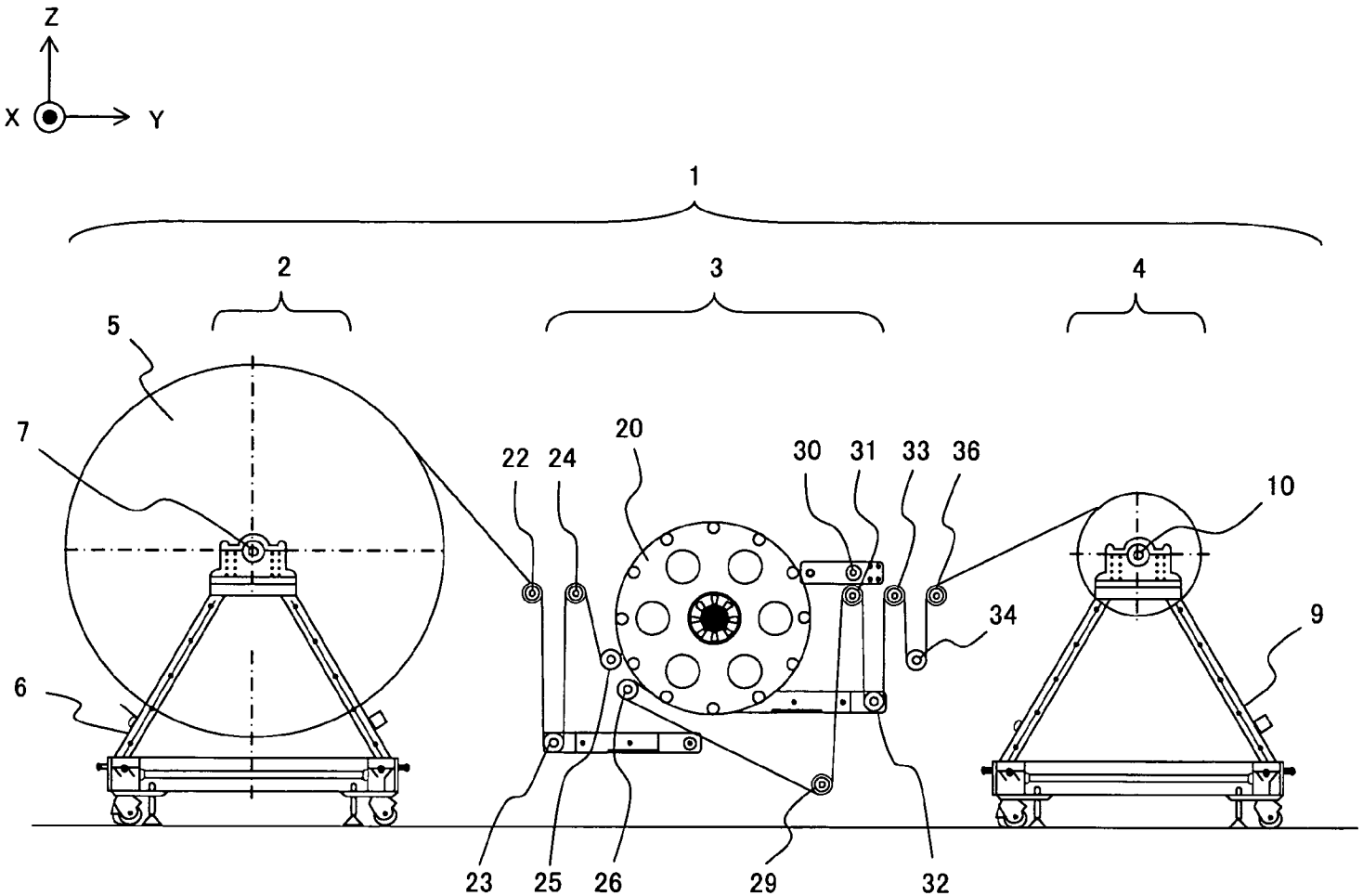
FIG. 3 is an outlined front view diagram showing a conveyance system for a continuous sheet.
Figure 4:
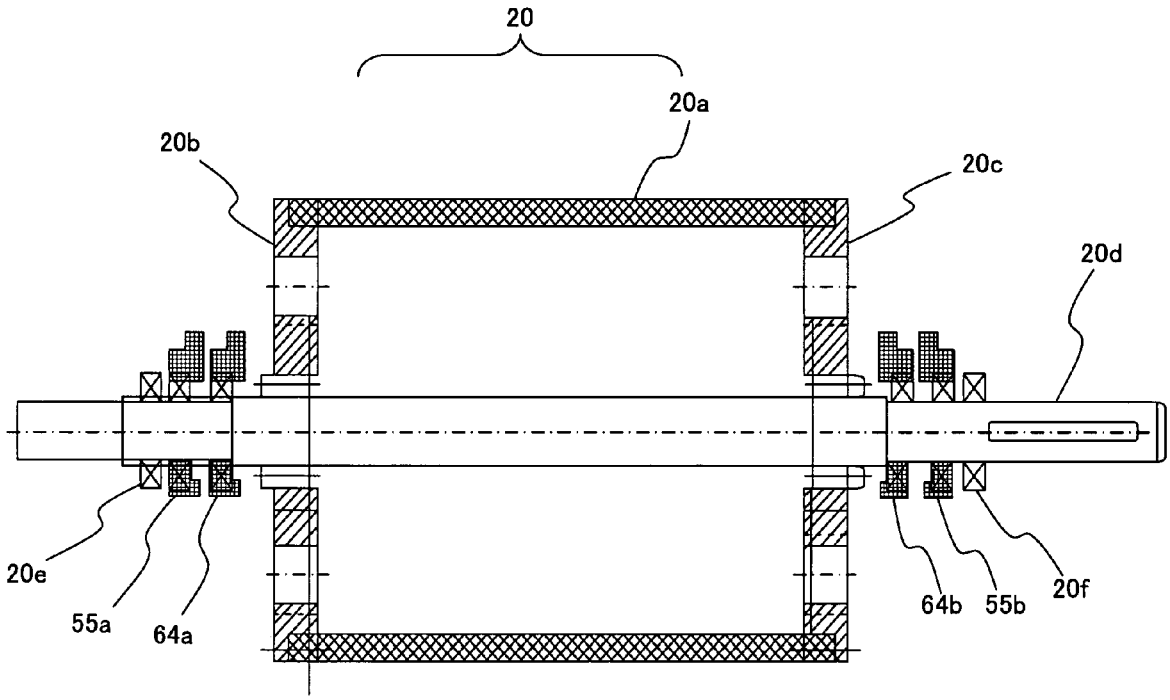
FIG. 4 is a diagram describing a configuration of a drum.
Figure 5:
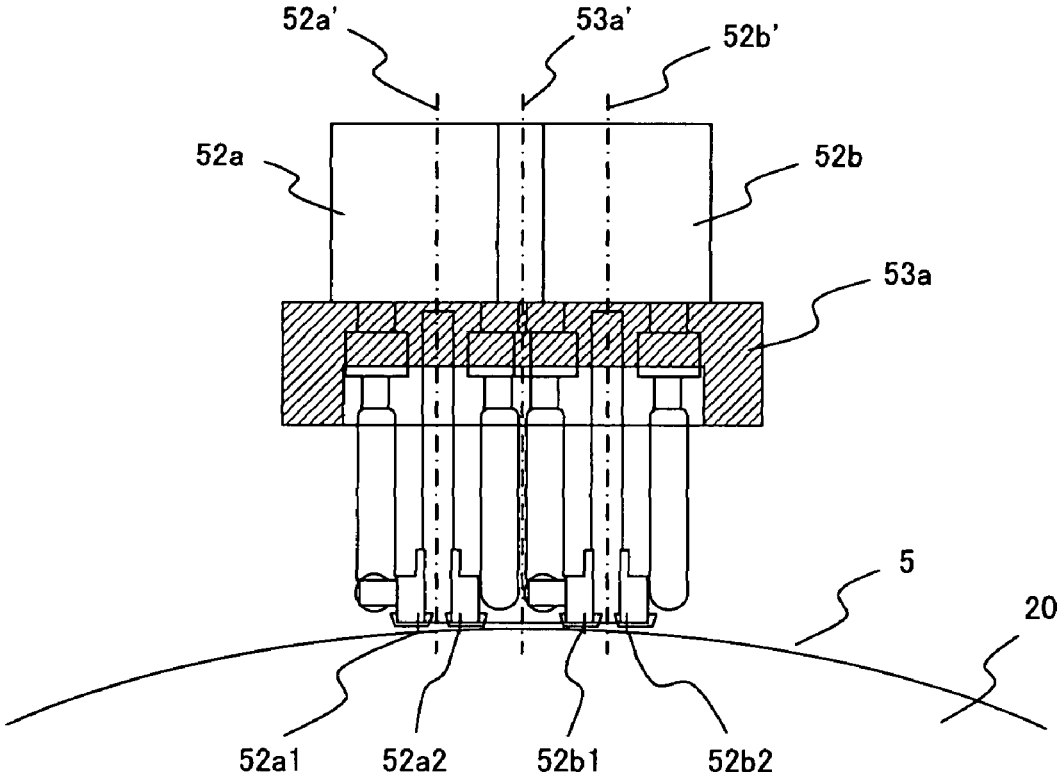
FIG. 5 is an outlined cross-sectional diagram of a print head and of a drum in the vicinity of the print head.
Figure 6:
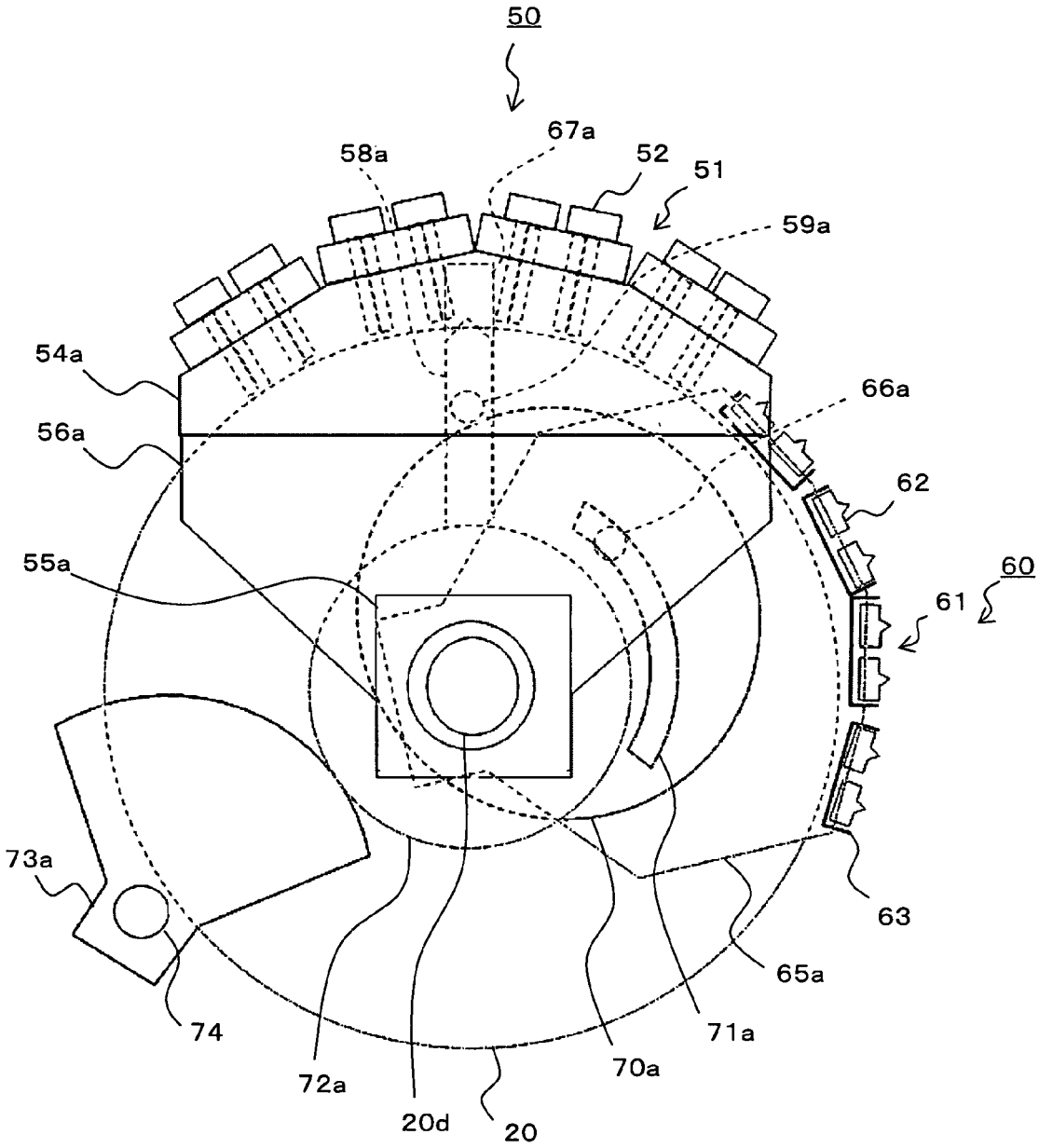
FIG. 6 is an outlined cross-sectional diagram of the vicinity of an image recording unit.
Figure 7:
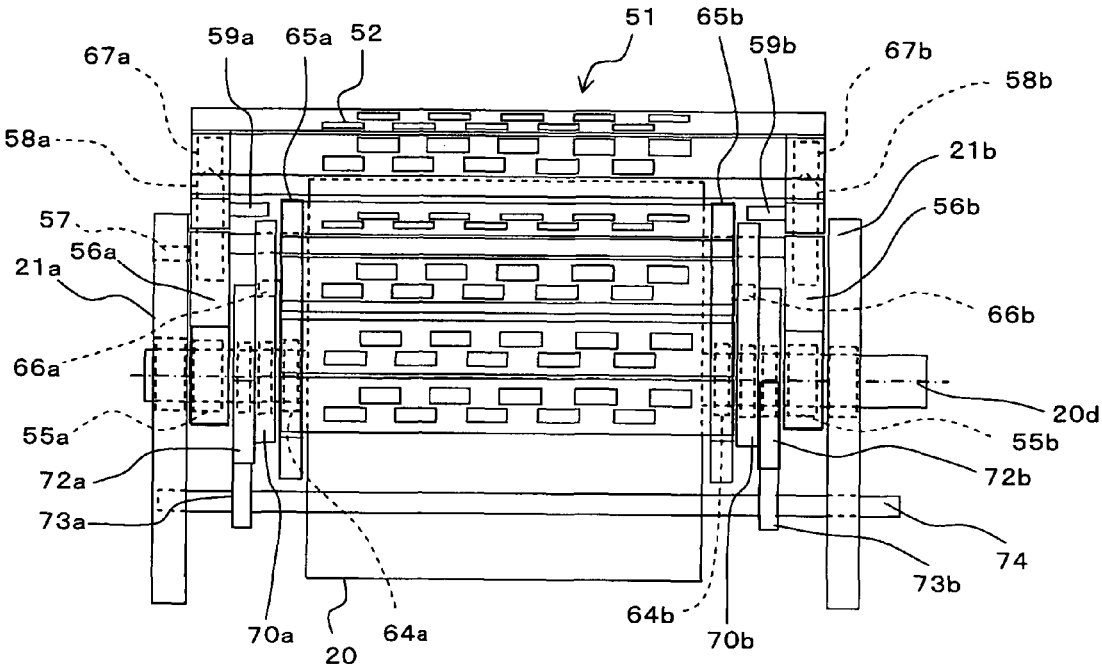
FIG. 7 is a side view diagram of the vicinity of an image recording unit.
Figure 8:
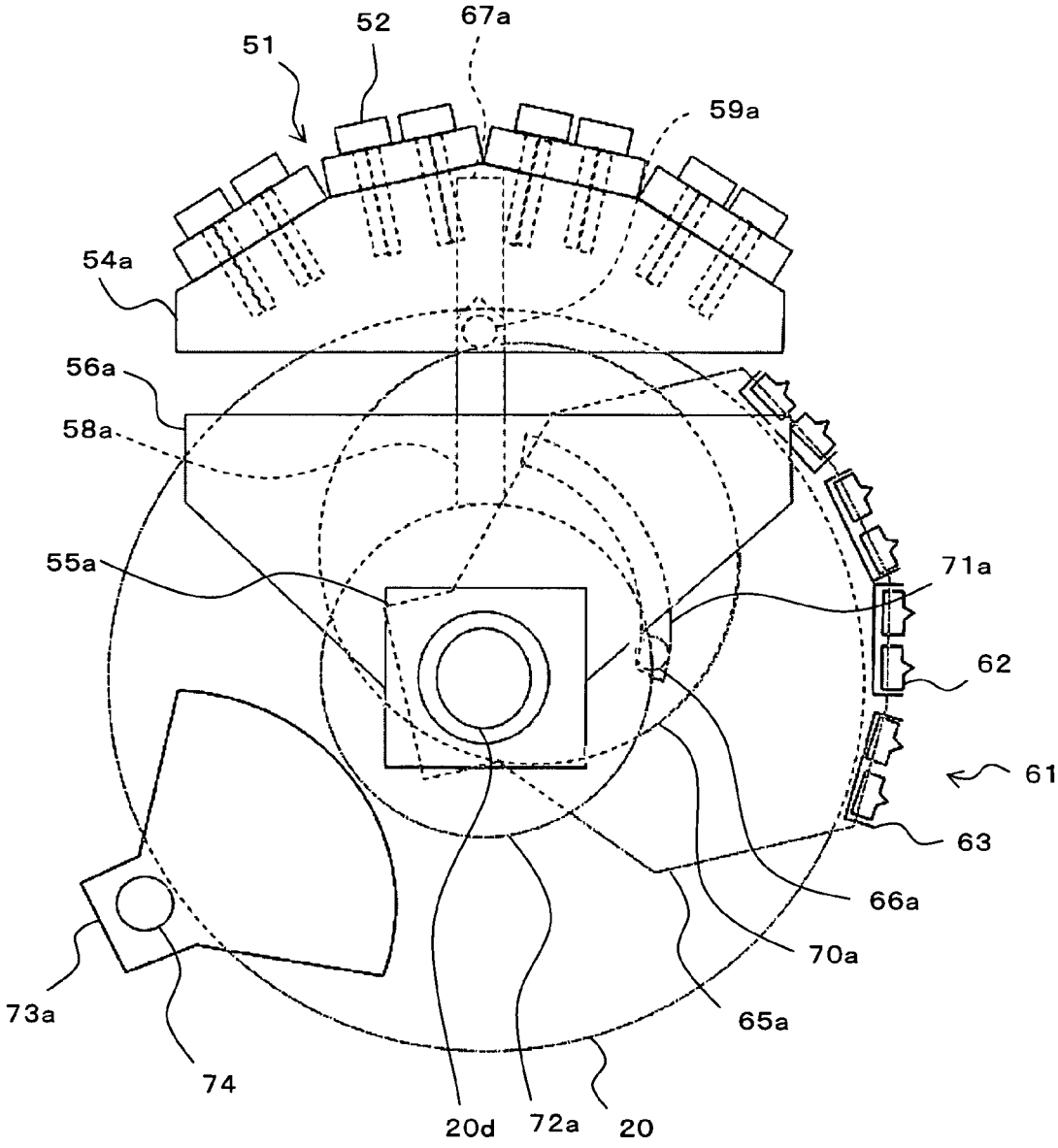
FIG. 8 is an outlined cross-sectional diagram of an image recording unit existing in a nonprinting position in which a printing is impossible.
Figure 9:
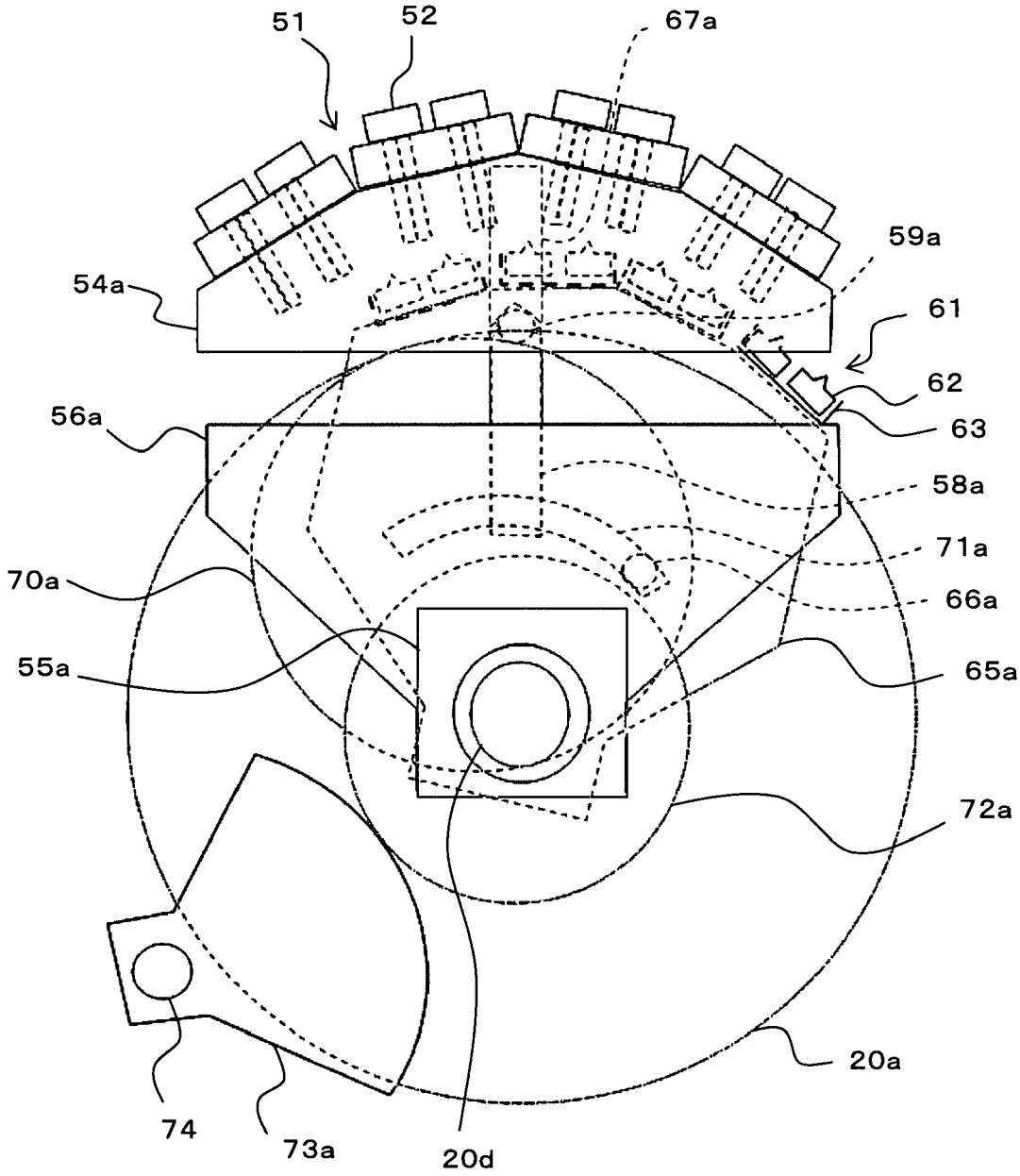
FIG. 9 is an outlined cross-sectional diagram of an image recording unit existing in a retract position.
Figure 10:
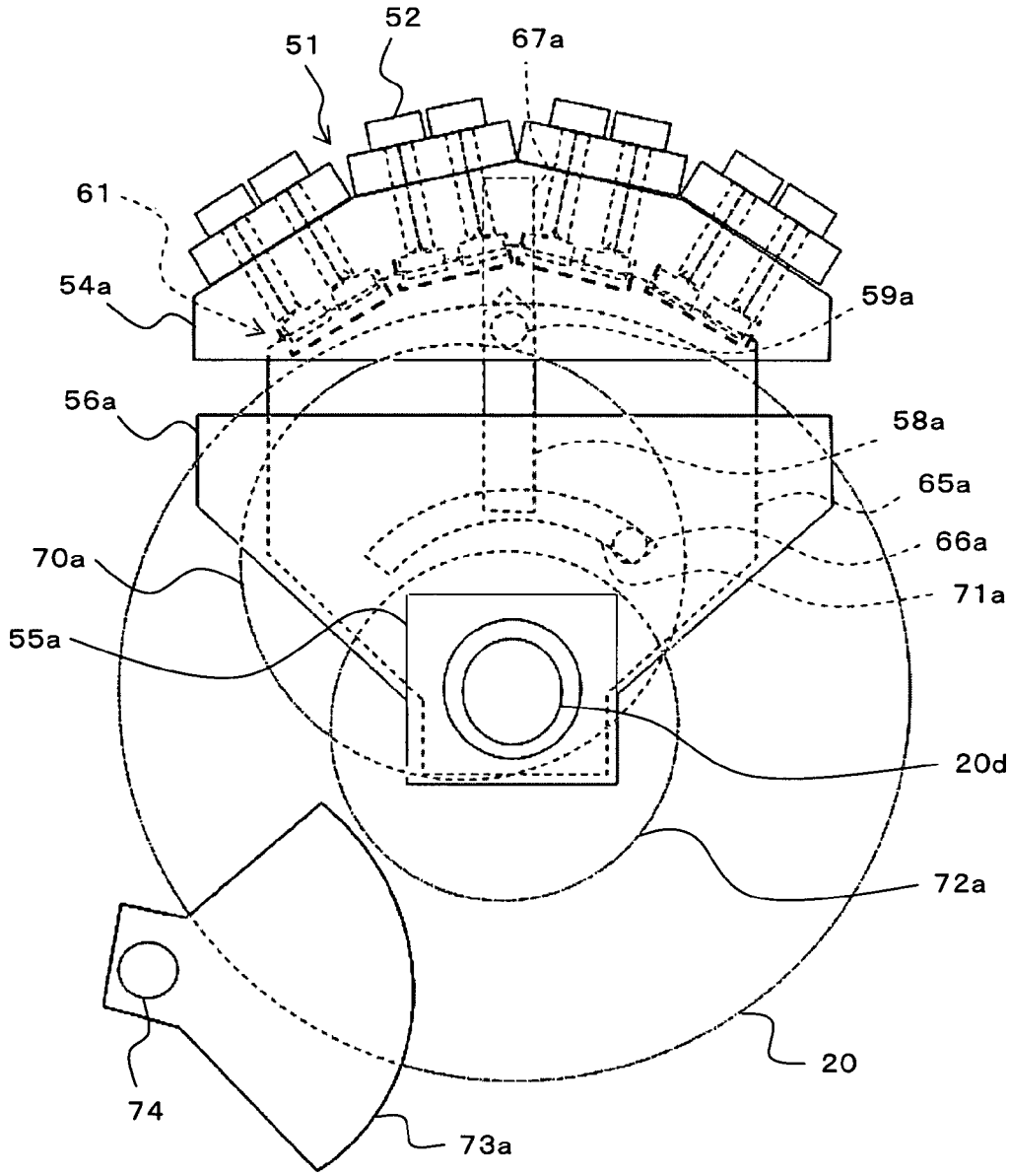
FIG. 10 is an outlined cross-sectional diagram of an image recording unit existing in a maintenance position.
Figure 11:
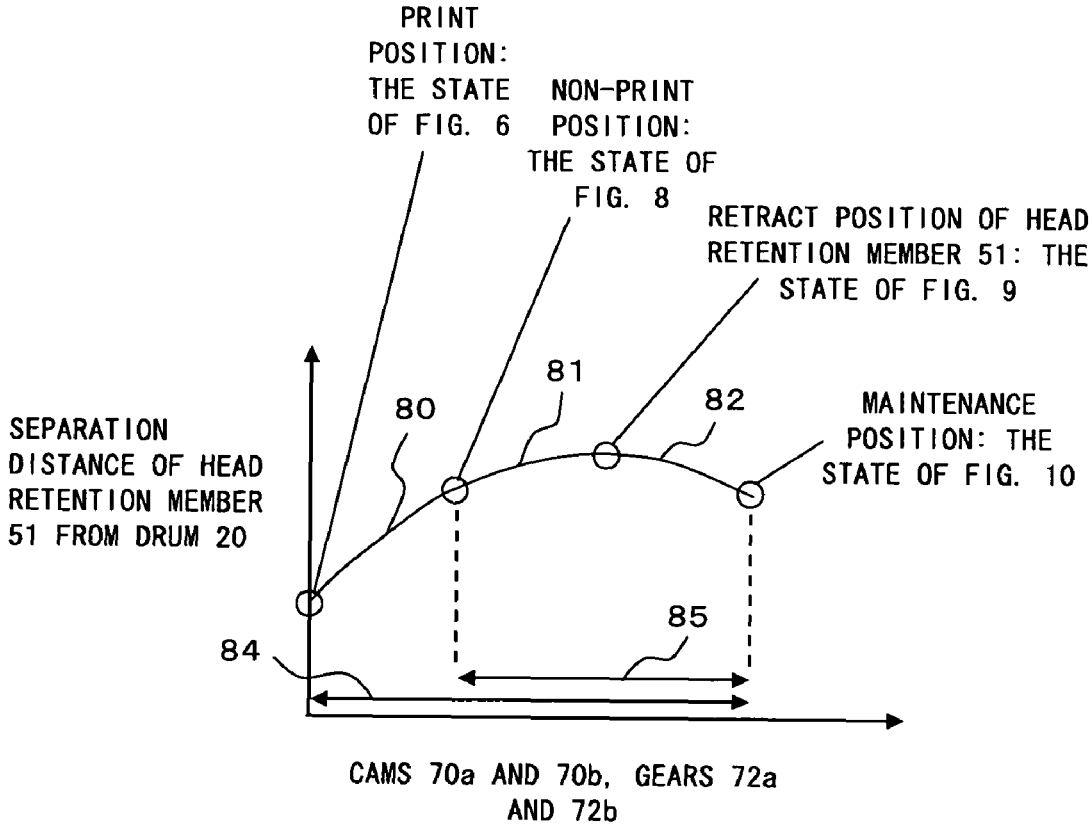
FIG. 11 is a diagram describing a characteristic of separating a drum and a head retention member relative to a rotation angle of a cam.

The following is a detailed description of the preferred embodiment of the present invention by referring to the accompanying drawings. The first is a description of a first preferred embodiment of the present invention by referring to FIGS. 1 through 11. FIG. 1 is a diagonal view diagram of a printer unit used for an image recording apparatus. FIG. 2 is an outlined front view diagram describing an image recording apparatus. FIG. 3 is an outlined front view diagram showing a conveyance system for a continuous sheet of paper (noted as "paper" as an example hereinafter). FIG. 4 is a diagram describing a configuration of a drum. FIG. 5 is an outlined cross-sectional diagram of a print head and of a drum in the vicinity of the print head. FIG. 6 is an outlined cross-sectional diagram of the vicinity of an image recording unit. FIG. 7 is a side view diagram of the vicinity of an image recording unit. FIG. 8 is an outlined cross-sectional diagram of an image recording unit existing in a nonprinting position in which a printing is impossible. FIG. 9 is an outlined cross-sectional diagram of an image recording unit existing in a retract position. FIG. 10 is an outlined cross-sectional diagram of an image recording unit existing in a maintenance position. FIG. 11 is a diagram describing a characteristic of separating a drum and a head retention member relative to a rotation angle of a cam. Note that in the present specification document, an axis along the recording medium conveyance direction is defined as Y axis, an axis perpendicular to the Y axis in a plane forming an image on a recording medium at the time of recording the image is defined as X axis, and an axis perpendicular to the X axis and Y axis is defined as Z axis.

The next is a description on the fundamental configuration of an image recording apparatus 1 according to the present invention by referring to FIGS. 1 through 7. The image recording apparatus 1 according to the present invention comprises an unwinder unit 2, a printer unit 3 and rewinder unit 4.

A description now is on a specific configuration of the unwinder unit 2 in the above fundamental configuration. The unwinder unit 2 comprises an unwinder unit stand 6 and a sheet pipe fix shaft 7. The unwinder unit 2 is for unwinding and feeding a continuous paper 5 as a recording medium to the printer unit 3. The present embodiment is configured so that the unwinder unit 2 retains a roll paper as a continuous paper 5. A size of the roll paper mountable on the unwinder unit 2 is 521 mm (20.5 inches) wide, 1.4 m of a roll diameter and a mass of 640 kg, for example.

The unwinder unit stand 6 supports the sheet pipe fix shaft 7 rotationally. The continuous paper 5 is retained by the sheet pipe fix shaft 7. In specific, an injection of air from an air injection hole (not shown in a drawing herein) of the sheet pipe fix shaft 7 expands a internal tube and a plurality of claw parts for chucking the paper pipe of the continuous paper 5 are protruded toward the radial direction. By this, the plurality of claw parts bites into the internal diameter of the paper pipe of the continuous paper 5 and retains it.

The drive force of a drive motor is transmitted to the sheet pipe fix shaft 7 by way of a pulley and a belt (which are not shown in a drawing herein) and the continuous paper 5 is unwound out in clockwise (CW) as shown in FIGS. 2 and 3. And a powder clutch for example is placed between the pulley and drive motor so as to give a back tension in the reverse direction of the conveyance direction of the continuous paper 5.

The next is a description of the printer unit 3. The printer unit 3 is configured to introduce the continuous paper 5 conveyed from the unwinder unit 2, convey the introduced continuous paper 5 to the immediate underside of the image recording unit 50 while retaining the continuous paper 5 is wound around the drum 20 and send the continuous paper 5 out to the rewinder unit 4. The printer unit 3 is constituted by a main body frame 21, an image recording unit 50, a maintenance mechanism 60 and a conveyance unit, for conveying the continuous paper 5, comprising a plurality of rollers and the drum 20 as shown in FIGS. 2 and 3.

The first is a description of the conveyance unit for the continuous paper 5. Referring to FIG. 3, the continuous paper 5 unwound out from the unwinder unit 2 is conveyed around the outer circumference of the drum 20 by way of a free roller 22, a dancer roller 23 and free rollers 24 and 25. The dancer roller 23 is rotationally mounted on the tip part of an arm having the rotational center on the main body frame 21.

The dancer roller 23 has the function of taking out a slack if and when the continuous paper 5 is slacked by a variation of the back tension caused by an eccentricity of the continuous paper 5 retained by the unwinder unit 2.

Meanwhile, both edges of the free roller 25 on the front and back sides are respectively equipped with tension detection sensors 27 of a differential method as shown in FIG. 2. The tension detection sensors 27 detect a tension of the continuous paper 5 at the beginning of winding it to the drum and operates the clutch connected to the sheet pipe fix shaft 7 of the unwinder unit 2 based on the output value of the tension, thereby controlling the back tension of the continuous paper 5.

The next is a description of a configuration of the drum 20. The drum 20 comprises a cylinder hollow unit 20*a*, flange units 20*b* and 20*c* on both ends, a rotation shaft 20*d*, engagement units 55*a* and 55*b* each for engaging one end of a support member supporting a head retention member (which is described later) with the rotation shaft 20*d* of the drum 20, engagement units 64*a* and 64*b* each for engaging one end of a maintenance unit retention member retaining a maintenance unit (which is described later) with the rotation shaft 20*d* of the drum 20, and bearings 20*e* and 20*f* for rotationally supporting the drum 20 onto the main body frame 21 as shown in FIG. 4. Incidentally, the engagement units 55*a* and 55*b* and the engagement units 64*a* and 64*b* are rotationally supported by the rotation shaft 20*d* of the drum 20.

The continuous paper 5 gives a normal force on the outer circumference of the drum 20 by applying the back tension at the beginning of winding, and the tension at the end of winding, around the drum 20 so as to be retained by the drum 20 by a friction coefficient between the drum 20 and the continuous paper 5 and conveyed by the drive force of the drive motor connected to the drum 20. Note that the present embodiment is configured to wrap the continuous paper 5 around the drum 20 by the wrapping angle of approximately 330 degrees.

After the end of winding around the drum 20, the continuous paper 5 is sent out to the rewinder unit 4 by way of free rollers 26 and 29, one pair of nip rollers 30 and 31, dancer roller 32, and free rollers 33, 34 and 36.

Both edges of the free roller 26 on the front and back sides are respectively equipped with tension detection sensors 28 of a differential method. The tension detection sensors 28 detect a tension at the end of winding on the drum 20 and operate a clutch and a brake both of which are connected to the nip roller 30 based on the output value of the detection, thereby controlling a winding tension of the continuous paper 5.

The dancer roller 32 is rotationally mounted on the tip part of an arm having the rotational center on the main body frame 21. The dancer roller 32 has the function of taking out a slack if and when the continuous paper 5 is slacked by a variation of tension caused by an eccentricity of the continuous paper 5 retained by the rewinder unit 4.

And both edges of the free roller 34 on the front and back sides are respectively equipped with tension detection sensors 35 of a differential method. The tension detection sensors 35 detect a tension between the rewinder unit 4 and the pair of nip rollers 30 and 31, and operate the clutch connected to the sheet pipe fix shaft 10 of the rewinder unit 4, thereby controlling the tension of the wound continuous paper 5.

The next is a description on the image recording unit 50. As shown in FIGS. 1, 5, 6 and 7, the image recording unit 50 is an inkjet apparatus for jetting an ink onto the continuous paper 5. The image recording unit 50 comprises a plurality of print heads 52, a head retention member 51, and support members 56*a* and 56*b*.

A description now is on the print head 52 to begin with. The print head 52 is an image-recording head for recording an image. The print head 52 according to the present embodiment is configured to form a print head of a resolution of 600 dots per inch (dpi) by adhesively attaching to heads of a resolution of 300 dpi with each head being displaced in the nozzle array direction. The print head 52 is fixed onto the head retention member 51. Note that the image recording unit 50 according to the present embodiment comprises the print heads 52 of a total of four colors, i.e., black (K), cyan (C), magenta (M) and yellow (Y). Therefore, each print head is fixed onto head retention plates 53*a*, 53*b*, 53*c* and 53*d* of the head retention member 51 for the respective colors, forming an assembly of image recording heads. The assembly of the image recording heads is equipped so that a size of the assembly in the X axis direction thereof is the same as, or more than, the maximum width of the continuous paper 5 to be used.

The print heads fixed onto the individual head retention plates 53*a*, 53*b*, 53*c* and 53*d* are arrayed in zigzag so as to overlap a part of each edge. Here, FIG. 5 shows a relative positional relationship between a nozzle face formed at the tip of the print head 52 and a print surface of the continuous paper 5 retained on the outer circumference of the drum 20 by exemplifying the K-color print head 52 for instance.

As shown in FIG. 5, the print heads 52*a* and 52*b* which are arrayed in zigzag are fixed onto the head retention plate 53*a*. The configuration is such that a center line 53*a*' bisecting the distance between a center line 52*a*' of the print head 52*a* and a center line 52*b*' of the print head 52*b* goes through the rotational center of the drum 20 and is parallel with the radial direction of the drum 20. The configuration is the same for the print heads 52 for other colors, i.e., cyan (C), magenta (M) and yellow (Y).

In this configuration, the amount of a gap to the print surface of the continuous paper 5 retained on the outer circumference of the drum 20 is different between the nozzle 52*a*1 and nozzle 52*a*2 for the print head 52*a*, and is also different between the nozzle 52*b*1 and nozzle 52*b*2 for the print head 52*b*. For the different gap amount, a color shift is corrected by adjusting the ink jetting timing of the print head 52. While the present embodiment is configured as described above, an alternative configuration may be such that the ink jetting direction of each print head is arrayed in parallel with the radial direction of the drum 20.

The next is a description of the head retention member 51 which comprises the above described head retention plates 53*a*, 53*b*, 53*c* and 53*d* and head retention side plates 54*a* and 54*b*, forming a single unit. The head retention plates 53*a*, 53*b*, 53*c* and 53*d* are equipped so that the size thereof in the X direction is equal to, or greater than, the size of the cylinder hollow unit 20*a* of the drum 20 in the X direction. As an example, if the image recording apparatus supports a recording of the paper of A3 size, the width of the head retention plates 53*a*, 53*b*, 53*c* and 53*d* is set at, or greater than, the width of the A3 size paper. The relative position of the print head 52 of each color is determined by the head retention member 51.

The next is a description on the support members 56*a* and 56*b* which are an essential part of the present embodiment.

As shown in FIGS. 1, 6 and 7, the configuration is such that the support member 56*a* is of a reversed trapezoid, and that the lower end part which is a first end part of the support member 56*a* is rotationally supported by the rotation shaft 20*d* of the drum 20 by way of the engagement unit 55*a* equipped in the drum 20 as specifically shown in FIG. 6. The support member 56*b* equipped in the back side of the image recording apparatus (sometimes abbreviated as "the apparatus" hereinafter) is also configured in the same manner.

And, referring to FIG. 6, the upper end part which is a second end part of the support member 56*a* is contacted to the end of the head retention side plate 54*a* of the head retention member 51, thus retaining the present head retention member 51. And the support member 56*b* placed on the back side of the apparatus is configured in the same manner. Such configurations of the support members 56*a* and 56*b* make the constituent components related between the print surface of the continuous paper 5 retained onto the outer circumference of the drum 20 and the nozzle face of the print head 52 only as follows: the drum 20, engagement members 55*a* and 55*b*, support members 56*a* and 56*b*, head retention side plates 54*a* and 54*b*, retention plates 53*a*, 53*b*, 53*c* and 53*d* and print head 52. This configuration makes it possible to reduce the number of components to a minimum, decrease the variation of the gap amount between the nozzle face of the print head 52 and the print surface of the continuous paper 5 caused by the variations of components and improve a print quality and a paper feed performance.

And, the connection of the main body frame 21*a* and head retention member 51 is comprised by only an engagement pin 57 on one side engaging the main body frame 21*a* to the support member 56*a* as shown in FIG. 7. This configuration does not allow the relative position between the head retention member 51 and drum 20 to be changed even if the two side plates of the main body frame 21*a* are twisted. This in turn maintains the relative position between the print head 52 retained by the head retention member 51 and the continuous paper 5 retained by the drum 20 even if the main body frame is deformed at the time of the transportation and/or installation of the apparatus or the main body frame is deformed due to temperature changes, thereby maintaining a print quality and a paper feed performance at the time of assembly and adjustment.

Furthermore, a use of the same material, as an example, for the support members 56*a* and 56*b*, for the head retention side plates 54*a* and 54*b* and retention plates 53*a*, 53*b*, 53*c* and 53*d* of the head retention member 51, and for the cylinder hollow unit 20*a* and flange units 20*b* and 20*c* of the drum 20 makes it possible to reduce the difference in thermal expansion between the drum 20 and head retention member 51, support members 56*a* and 56*b*. This configuration reduces a change of the relative positional relationship between the head retention member 51 and drum 20 due to thermal expansions of the constituent components caused by the temperature changes in the usage environment of the apparatus and the temperature changes stemming from heat generation within the apparatus, thereby making it possible to reduce or prevent a degradation of a print quality and of a paper feed performance.

The next is a description on the maintenance mechanism 60. The maintenance mechanism 60 comprises a maintenance unit 61 and maintenance unit retention members 65*a* and 65*b* as shown in FIGS. 1 and 6. The maintenance unit 61 has the function of performing a maintenance operation such as wiping and nozzle suction for example for the nozzle face of the print head 52 in order to prevent a clogging. The maintenance unit 61 comprises a plurality of suction nozzles 62 corresponding to a plurality of print heads 52 and an ink pan 63 for collecting purged ink at the time of a maintenance operation. The maintenance unit retention members 65*a* and 65*b* are rotationally supported by the rotation shaft 20*d* of the drum 20 by way of the engagement units 64*a* and 64*b* which are equipped in the drum 20 at the first end part, and stationarily supports the maintenance unit 61 at the second end part.

The maintenance operation begins with an ink purge operation from each print head 52. The ink flowing out at the purge is collected by the ink pan 63, which is provided for a print head for each color, and collected in a waste fluid tank (not shown in a drawing herein) as waste fluid. Then, the operation scans the suction nozzles 62 in the state of contacting with the nozzle face of each print head in the X axis direction and suctions the ink on the nozzle face while the suction nozzles 62 sweeping the ink attached on the nozzle face of the print head 52.

The next is a description on the rewinder unit 4. The rewinder unit 4 comprises a rewinder unit stand 9 and a sheet pipe fix shaft 10. The rewinder unit 4 retains the rewound continuous paper 5 rotationally and rewinds the continuous paper 5 printed at the printer unit 3.

The rewinder unit stand 9 supports the sheet pipe fix shaft 10 rotationally and retains the continuous paper 5 rewound by the sheet pipe fix shaft 10. Also in the sheet pipe fix shaft 10, a plurality of claw parts protrudes in the radial direction as a result of injecting air from an air injection hole in the same manner as the above described sheet pipe fix shaft 7 and the claw parts bite into the inner diameter of the paper pipe of the rewound continuous paper 5, thereby retaining it.

The drive force of a drive motor is transmitted to the sheet pipe fix shaft 10 by way of a pulley and a belt (which are not shown in a drawing herein) so as to rewind the continuous paper 5 in CW as shown in FIGS. 2 and 3. And a powder clutch for example is placed between the pulley and drive motor, and a tension of the continuous paper 5 in the conveyance direction is adjusted by the powder clutch.

The next is a description of a configuration of a mechanism for setting the image recording apparatus 1 of the present embodiment in a print state and a maintenance state based on the movements of the head retention member 51 and maintenance mechanism 60.

The position of the head retention member 51 is determined by the above described support members 56*a* and 56*b* in the Z axis direction and by the guide shafts 58*a* and 58*b* which are guide members fixed onto the support members 56*a* and 56*b* in the X axis direction which is the width direction of the continuous paper 5 in relation to the drum 20 and in the Y axis direction which is the conveyance direction of the continuous paper 5.

The configuration is such that the center axis of the guide shafts 58*a* and 58*b* is an axis going through the center of the drum 20, is parallel with the radial direction of the drum 20 and is an axis equally dividing the head retention plates 53*a* and 53*b* and head retention plates 53*c* and 53*d* of the head retention member 51. The head retention side plates 54*a* and 54*b* are equipped with fit units 67*a* and 67*b* fitting with the guide shafts 58*a* and 58*b*. Movements of the fit units 67*a* and 67*b* along the guide shafts 58*a* and 58*b* make it possible to separate the head retention member 51 in the radial direction of the drum 20. Note that an equipment of the guide shafts 58*a* and 58*b* in the head retention side plates 54*a* and 54*b*, and that of the fit units 67*a* and 67*b* in the support members 56*a* and 56*b* make it possible to separate the head retention member 51 in the radial direction of the drum 20.

Meanwhile, the maintenance unit 61 is fixed onto respective one ends (i.e., the second end parts) of the maintenance unit retention members 65*a* and 65*b*. The other ends (i.e., the first end parts) of the maintenance unit retention members 65*a* and 65*b* are rotationally supported by the rotation shaft 20*d* of the drum 20 by way of the engagement units 64*a* and 64*b*. This configuration makes the maintenance unit 61 retained rotationally around the rotation shaft 20*d* of the drum 20.

The next is a description on a drive transmission member for transmitting a drive force to the head retention member 51 and maintenance unit 61. Cams 70*a* and 70*b* and gears 72*a* and 72*b* are drive transmission members for transmitting drive forces to the head retention member 51 and maintenance unit 61. The cam 70*a* and gear 72*a* are configured to be integral and placed between the support member 56*a* and maintenance unit retention member 65*a* on the rotation shaft 20*d* of the drum 20. Likewise, the cam 70*b* and gear 72*b* are configured to be integral and placed between the support member 56*b* and maintenance unit retention member 65*b*.

The outer circumference of the cams 70*a* and 70*b* are circles, having the center of rotation at a position displaced from the center of the outer circumference. The cams 70*a* and 70*b* are rotationally supported by the rotation shaft 20*d* of the drum 20. The cams 70*a* and 70*b* are also featured with circular grooves 71*a* and 71*b*, respectively. The outer circumference of the cams 70*a* and 70*b* are in contact with contact parts 59*a* and 59*b* featured in the inside of the head retention member 51, thereby transmitting a drive force thereto. The contact parts 59*a* and 59*b* of the head retention member 51 slide on the cams 70*a* and 70*b* and therefore are constituted by bearings for example. As such, the contact parts 59*a* and 59*b* sliding on the cams 70*a* and 70*b* make it possible to separate the head retention member 51 from the drum 20. In this event, the head retention member 51 is moved in parallel with the radial direction of the drum 20 by the fit units 67*a* and 67*b* equipped in the head retention side plates 54*a* and 54*b* and by the guide shafts 58*a* and 58*b* equipped in the support members 56*a* and 56*b*.

Contact pins 66*a* and 66*b* inserted into the maintenance unit retention members 65*a* and 65*b* for retaining the maintenance unit 61 are engaged with circular grooves 71*a* and 71*b* of the cams 70*a* and 70*b*, thereby transmitting a drive force to the maintenance mechanism 60.

The gears 72*a* and 72*b* integrally configured with the cams 70*a* and 70*b* are also rotationally retained to the rotation shaft 20*d* of the drum 20. Drive gears 73*a* and 73*b* are meshed with the gears 72*a* and 72*b*. The gears 73*a* and 73*b* are equipped on a drive shaft 74 connecting the main body frames 21*a* and 21*b*. A drive motor that is a drive source is connected to the drive shaft 74. Therefore, a rotation of the drive shaft 74 by means of the drive motor transmits a drive force to the gears 72*a* and 72*b* by way of the drive gears 73*a* and 73*b*.

The next is a description on an operating of a mechanism for setting the head retention member 51 and maintenance unit 61 in a print state and a maintenance state.

The head retention member 51 is capable of moving to a print position enabling a print on the continuous paper 5 as shown in the above described FIG. 6, a non-print position disenabling a print as shown in FIG. 8, a retract position of the head retention member 51 enabling a movement of the maintenance unit 61 on the immediate underside of the print head without an interference as shown in FIG. 9, and a maintenance position enabling a start of a maintenance operation as a result of the print head 52 being retained by the head retention member 51 contacting with the suction nozzle 62 of the maintenance unit 61 as shown in FIG. 10.

Meanwhile, the maintenance unit 61 is capable of moving to a standby position in which it is in the standby state as shown in FIGS. 6 and 8, a retract position of the head retention member 51 enabling a movement of the maintenance unit 61 on the immediate underside of the print head without an interference as shown in FIG. 9, and a maintenance position enabling a start of a maintenance operation as a result of the print head 52 retained by the head retention member 51 contacting with the suction nozzle 62 of the maintenance unit 61 as shown in FIG. 10.

FIG. 11 is a diagram describing the relationships among a rotation angle of the cams 70*a* and 70*b* and that of the gears 72*a* and 72*b*, a distance of the head retention member 51 separating from the drum 20 and a rotation movement angle of the maintenance unit 61. Here, a numeral 84 indicated in FIG. 11 is the angle of the circular grooves 71*a* and 71*b* featured in the cams 70*a* and 70*b*.

When the head retention member 51 and maintenance unit 61 move from the print position shown in FIG. 6 to the non-print position shown in FIG. 8, which is indicated by the curve 80 in FIG. 11, the cams 70*a* and 70*b* and the gears 72*a* and 72*b* rotate in counterclockwise (CCW) . And the contact parts 59*a* and 59*b* sliding on the circumferences of the cams 70*a* and 70*b* separate the head retention member 51 from the drum 20. In this event, the maintenance unit 61, allowing the contact pins 66*a* and 66*b* to slide from the left end to right end along the circular grooves 71*a* and 71*b*, does not start moving and therefore remains in the standby state.

Then, when the head retention member 51 and maintenance unit 61 move from the non-print position shown in FIG. 8 to the retract position of the head retention member 51 shown in FIG. 9, which is indicated by the curve 81 in FIG. 11, the cams 70*a* and 70*b* and the gears 72*a* and 72*b* further rotate in CCW. Associated with this, the head retention member 51 further separates itself from the drum 20, at which point the head retention member 51 is at the farthest distance from the drum 20 according to the configuration of setting the phase of the cams 70*a* and 70*b*. In this event, the maintenance unit 61 starts moving rotationally in CCW as the contact pins 66*a* and 66*b* contacting with the rightmost end of the circular grooves 71*a* and 71*b* (as shown by a numeral 85 in FIG. 11 indicating the rotational movement angle of the maintenance unit 61).

Then, the head retention member 51 and maintenance unit 61 move from the retract position of the head retention member 51 shown in FIG. 9 to the maintenance position shown in FIG. 10, which is indicated by the curve 82 in FIG. 11, the cams 70*a* and 70*b* and the gears 72*a* and 72*b* further rotate in CCW. Associated with this, the head retention member 51 moves toward the drum 20 and suction nozzle 62 of the maintenance unit 61. In this event, the maintenance unit 61 rotationally moves to the immediate underside of the print head 52 retained by the head retention member 51, becoming the state of the suction nozzles 62 of the maintenance unit 61 contacting with the print head 52. In this state, the above described maintenance operation is enabled to start.

When returning the head retention member 51 and maintenance unit 61 to the print state upon finishing the maintenance operation, the cams 70*a* and 70*b* and the gears 72*a* and 72*b* are rotated in CW, thereby returning to the print state.

As described above, the present embodiment is configured to support respective one ends of the support members 56*a* and 56*b* retaining the head retention member 51 rotationally by the rotation shaft 20*d* of the drum 20. This configuration makes it possible to record in a high image quality because the relative positional relationship of the head retention member 51 based on the rotation shaft 20*d* of the drum 20 as reference.

Also, respective one ends of the maintenance unit retention members 65*a* and 65*b* retaining the maintenance unit 61 are rotationally engaged with the rotation shaft 20*d* of the drum 20. This configuration determines the relative positional relationship of the head retention member 51 and maintenance unit 61 by using the rotation shaft 20*d* of the drum 20 as reference, thereby making it possible to stabilize the maintenance operation.

Furthermore, the head retention member 51 and maintenance unit 61 can be driven by the cams 70*a* and 70*b* and the gears 72*a* and 72*b* that are the common drive transmission members, and therefore a space occupied by the drive transmission members can be reduced to a minimally required within the apparatus. Also, there is no requirement of an independent drive transmission member or drive source respectively for the head retention member 51 and maintenance unit 61, thereby making it possible to provide a compact and low cost apparatus.

That is, enabled is a provision of an image recording apparatus reducing a variation of the relative position of the head retention member, maintenance unit and drum, and hence improving a print quality and a paper feed performance.

Incidentally, if a drive source of the head retention member 51 and maintenance unit 61 is changed over between the time of printing by way of the drive motor and clutch of the drum 20, a common use with the drive motor of the drum 20 is enabled, and hence a more compact and low cost apparatus can be provided.

The next is a description of a preferred second embodiment of the present invention.

Figure 12:
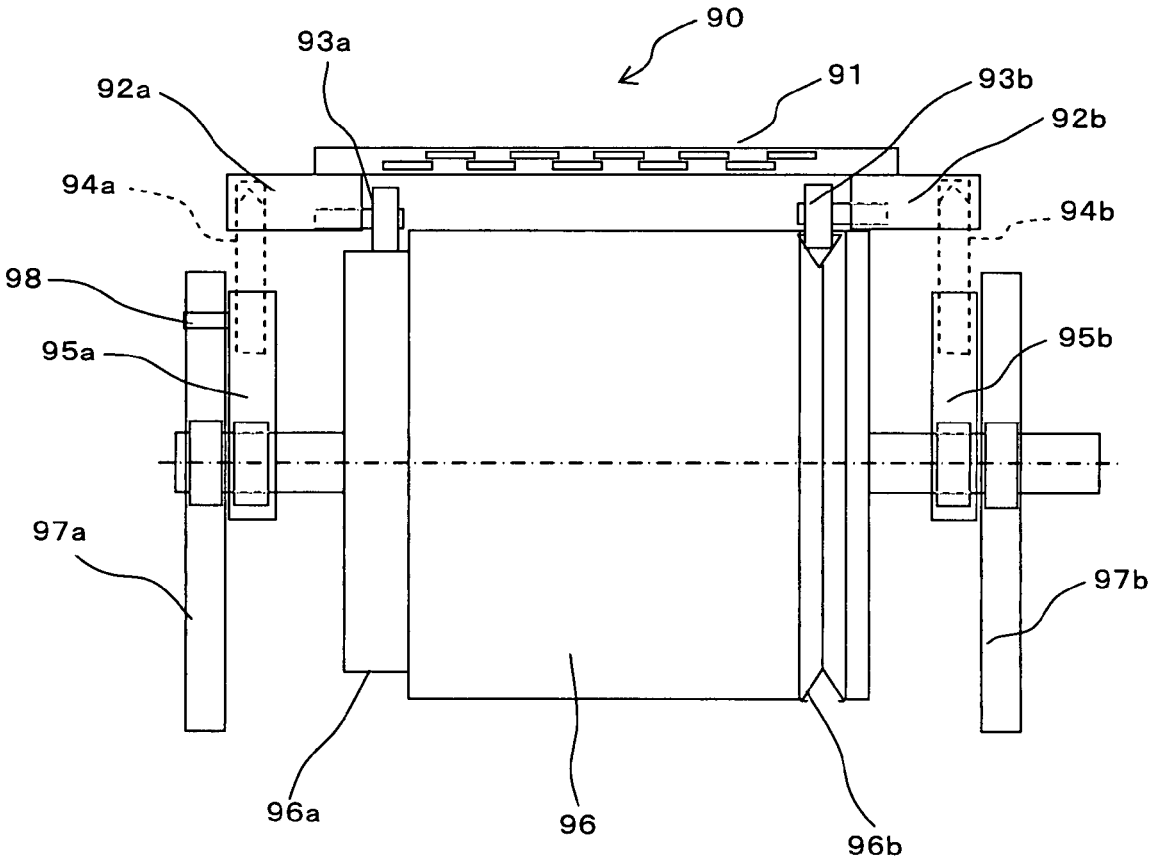
FIG. 12 is a diagram describing a configuration of an image recording unit according to a second preferred embodiment.
Figure 13:
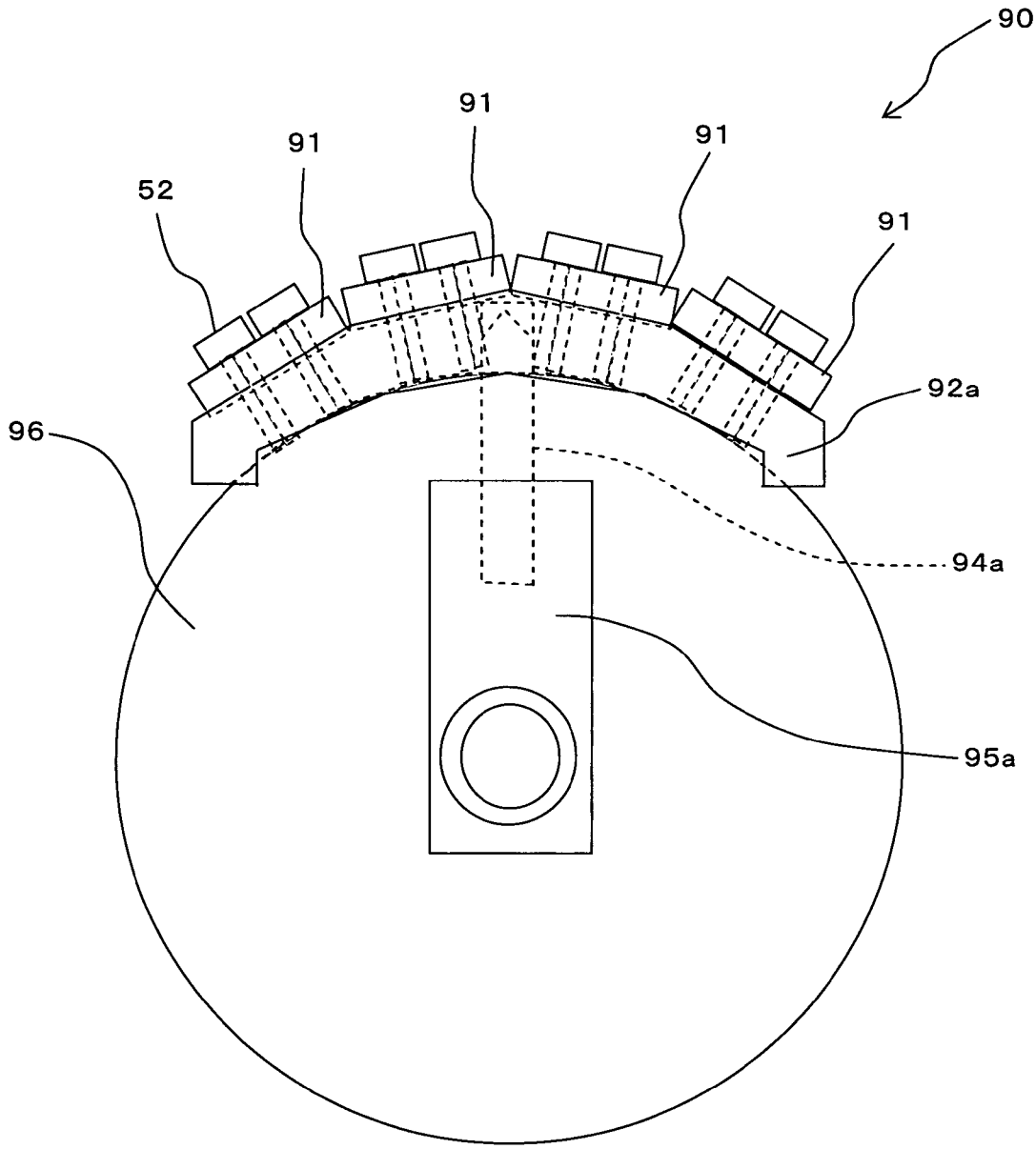
FIG. 13 is an outlined cross-sectional diagram of an image recording unit according to the second embodiment.

FIGS. 12 and 13 are diagrams describing an image recording unit according to the present embodiment. The present embodiment is basically constituted by a head retention member 90, a drum 96, engagement units 95*a* and 95*b*, and main body frames 97*a* and 97*b*. Note that the comprisal of the maintenance unit 61, maintenance unit retention members 65*a* and 65*b*, engagement units 64*a* and 64*b* which are related to the above described maintenance mechanism 60 and the comprisals of the above described cams 70*a* and 70*b* and the gears 72*a* and 72*b* are omitted in the showing of FIGS. 12 and 13 because these are the same as in the case of the first embodiment. Also omitted here are the descriptions of the same configuration and operation as the above described first embodiment.

The engagement units 95*a* and 95*b* are equipped with guide shafts 94*a* and 94*b*, and the head retention member 90 is enabled to move in parallel with the radial direction of the drum 96. And the main body frame 97*a* is connected to the head retention member 90 by using only one engagement pin 98 connecting the main body frame 97*a* to the engagement unit 95*a* in one spot.

The next is a description of the major point of the present embodiment.

The drum 96 has a guide unit for guiding support members 93*a* and 93*b* on both ends of the drum 96. The guide unit is constituted by a guide groove 96*a* which is formed by a cylindrical surface that is cut in by a step from the outer circumference of the drum 96 and by a V-shaped drum guide groove 96*b* featured on the back side of the apparatus.

The head retention member 90 is constituted by four head retention plates 91 retaining the print head 52, and head retention side plates 92*a* and 92*b*. The support members 93*a* and 93*b* (the present embodiment comprises one support member 93*a* and two support members 93) have the function of determining the relative position between the drum 96 and head retention member 90, and the support members 93*a* and 93*b* are made of bearings for example. The outer circumference of the bearings respectively contact with the drum guide grooves 96*a* and 96*b*, determining the gap amount between the print head 52 and drum 96. The position of the head retention member 90 in the axis direction of the drum 96 is determined by the support member 93*b* and the V-shaped drum guide groove 96*b*.

This configuration makes it possible to further reduce the number of components as compared to the above described first embodiment, further decrease a variation of the gap amount from the nozzle face of the print head 52 to the print surface of the continuous paper 5 and improve the print quality and paper feed performance. That is, the present embodiment enables a comprisal between the drum 96 and head retention member 90 merely by making the support member 93*a* and head retention side plate 92*a* (and also the support member 93*b* and head retention side plate 92*b*) intervene, thereby making it possible to configure an image recording apparatus of the present embodiment by using a smaller number of components and further improve a print quality and paper feed performance. Note that the first and second embodiment have been described by exemplifying a use of the continuous paper as a recording medium; a cut paper may be used as a recording medium, however, in lieu of being limited to the present embodiments. Also, the first and second embodiment have been described by exemplifying a use of paper as representative; a use of various materials, such as plastic sheet, may be applicable as the recording media depending on a use of a kind of ink, however, in lieu of the recording medium applicable to the present invention being limited to paper.

What is claimed is:

1. An image recording apparatus, comprising:

a rotational drum for retaining a recording medium on an outer circumference of the drum;

a head retention member provided opposite to the outer circumference of the drum, the head retention member retaining a print head which prints on the recording medium by jetting ink from a plurality of nozzles;

a support member which supports the head retention member at a prescribed position in relation to the drum;

a head movement mechanism which makes the head retention member movable in relation to the drum; and a guide unit which regulates a movement direction of the head retention member, the guide unit comprising (i) a guide member provided in the support member, and (ii) a fit unit provided in the head retention member which slidablv fits the guide member;

wherein the support member is engaged with a rotation shaft of the drum; and wherein the guide unit regulates so as to make the movement direction of the head retention member parallel with a radial direction of the drum.

2. The image recording apparatus according to claim 1, wherein the support member is supported rotationally in relation to the rotation shaft of the drum.

3. The image recording apparatus according to claim 1, wherein the material of at least one of the support member and the head retention member comprises a same material as that of the drum.

4. An image recording apparatus comprising:

a rotational drum for retaining a recording medium on an outer circumference of the drum;

a head retention member provided opposite to the outer circumference of the drum, the head retention member retaining a print head which prints on the recording medium by jetting ink from a plurality of nozzles;

a support member which supports the head retention member at a prescribed position in relation to the drum;

a head movement mechanism which makes the head retention member movable in relation to the drum; and a guide unit which regulates a movement direction of the head retention member, the guide unit comprising (i) a guide member provided in the head retention member, and (ii) a fit unit provided in the support member which slidablv fits the guide member;

wherein the support member is engaged with a rotation shaft of the drum; and wherein the guide unit regulates so as to make the movement direction of the head retention member parallel with a radial direction of the drum.

5. The image recording apparatus according to claim 1, further comprising:

a maintenance unit which carries out maintenance of a nozzle face comprising the plurality of nozzles of the print head, a maintenance unit retention member which retains the maintenance unit, a maintenance unit movement mechanism which moves the maintenance unit retention member to a retraction position, which is retracted from the print head, and to a maintenance position for carrying out the maintenance of the nozzle face, and a head movement mechanism which moves the head retention member to an image recording position for recording an image on the recording medium and to the maintenance position for carrying out the maintenance of the nozzle face, wherein a common drive source drives the head movement mechanism and the maintenance unit movement mechanism.

6. The image recording apparatus according to claim 1, further comprising:

a maintenance unit which carries out maintenance of a nozzle face comprising the plurality of nozzles of the print head, and a maintenance unit retention member which retains the maintenance unit, wherein the maintenance unit retention member is engaged with the rotation shaft of the drum.

7. The image recording apparatus according to claim 6, wherein the maintenance unit retention member is supported rotationally in relation to the rotation shaft of the drum and rotates around the rotation shaft of the drum.

8. The image recording apparatus according to claim 4, wherein the support member is supported rotationally in relation to the rotation shaft of the drum.

9. The image recording apparatus according to claim 4, wherein the material of at least one of the support member and the head retention member comprises a same material as that of the drum.

10. The image recording apparatus according to claim 4, further comprising:

a maintenance unit which carries out maintenance of a nozzle face comprising the plurality of nozzles of the print head, a maintenance unit retention member which retains the maintenance unit, a maintenance unit movement mechanism which moves the maintenance unit retention member to a retraction position, which is retracted from the print head, and to a maintenance position for carrying out the maintenance of the nozzle face, and a head movement mechanism which moves the head retention member to an image recording position for recording an image on the recording medium and to the maintenance position for carrying out the maintenance of the nozzle face, wherein a common drive source drives the head movement mechanism and the maintenance unit movement mechanism.

11. The image recording apparatus according to claim 4, further comprising:

a maintenance unit which carries out maintenance of a nozzle face comprising the plurality of nozzles of the print head, and a maintenance unit retention member which retains the maintenance unit, wherein the maintenance unit retention member is engaged with the rotation shaft of the drum.

12. The image recording apparatus according to claim 11, wherein the maintenance unit retention member is supported rotationally in relation to the rotation shaft of the drum and rotates around the rotation shaft of the drum.

* * * * *